US009960508B2

(12) United States Patent
Nichols et al.

(10) Patent No.: US 9,960,508 B2
(45) Date of Patent: May 1, 2018

(54) WIRE LUG CONNECTOR

(71) Applicant: Tyco Electronics Corporation, Berwyn, PA (US)

(72) Inventors: Robert Paul Nichols, Vacaville, CA (US); Michael Allen Blanchfield, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 14/285,207

(22) Filed: May 22, 2014

(65) Prior Publication Data

US 2015/0340779 A1 Nov. 26, 2015

(51) Int. Cl.

| | |
|---|---|
| ***H01R 12/58*** | (2011.01) |
| ***H01R 12/53*** | (2011.01) |
| ***H01R 12/75*** | (2011.01) |
| *H01R 12/70* | (2011.01) |

(52) U.S. Cl.

CPC ..... *H01R 12/585* (2013.01); *H01R 12/53* (2013.01); *H01R 12/75* (2013.01); *H01R 12/7088* (2013.01)

(58) Field of Classification Search

CPC ..... H01R 12/53; H01R 12/585; H01R 12/75; H01R 12/7088

USPC ..... 439/581, 63, 84, 98, 103, 751, 873, 843, 439/733.1

See application file for complete search history.

(56) References Cited

U.S. PATENT DOCUMENTS

| | | | | |
|---|---|---|---|---|
| 3,915,535 | A * | 10/1975 | O'Keefe et al. | 439/63 |
| 4,191,440 | A * | 3/1980 | Schramm | 439/751 |
| 4,784,613 | A | 11/1988 | Deisch | |
| 5,761,050 | A * | 6/1998 | Archer | 361/791 |
| 6,428,329 | B2 * | 8/2002 | Orui | H01R 43/205 439/65 |
| 6,808,395 | B2 | 10/2004 | Lin et al. | |
| 7,491,087 | B2 | 2/2009 | Swantner et al. | |
| 7,963,796 | B2 | 6/2011 | Sypolt et al. | |

(Continued)

FOREIGN PATENT DOCUMENTS

| | | | |
|---|---|---|---|
| DE | 202006004404 U1 * | 7/2006 | H01R 12/585 |
| DE | 102007037839 | 2/2008 | |

(Continued)

OTHER PUBLICATIONS

Machine translation of DE 20 2011 005 385 U1 (Engel et al.) (published Sep. 22, 2011).*

(Continued)

*Primary Examiner* — Renee Luebke
*Assistant Examiner* — Paul Baillargeon

(57) ABSTRACT

A wire lug connector includes a lug having a termination end configured to be terminated to a conductor of a wire. The lug has a conductive base at a mounting end configured to be mounted to a substrate. The base has a plurality of compliant pins extending from a bottom of the base. The compliant pins are electrically connected to the conductor by the base. The compliant pins are configured to be mechanically and electrically connected to the substrate. The compliant pins may have double ended press-fit sections at opposite heads and tails of the compliant pins that are press-fit into corresponding openings in the base and vias in the substrate.

16 Claims, 3 Drawing Sheets

(56) References Cited

U.S. PATENT DOCUMENTS

| | | | | |
|---|---|---|---|---|
| 8,202,121 | B2 | 6/2012 | Nichols | |
| 2011/0177722 | A1* | 7/2011 | Casses et al. | 439/660 |

FOREIGN PATENT DOCUMENTS

| | | | | |
|---|---|---|---|---|
| DE | 202011005385 | U1 * | 8/2011 | H01R 4/20 |
| DE | 102010034790 | | 2/2012 | |

OTHER PUBLICATIONS

Professional translation of the final two sentences of paragraph [0032] of DE 20 2011 005 385 U1 (published Sep. 22, 2011).*
European Search Report dated Sep. 11, 2015 received in counterpart EP Application No. 15168185.5.

* cited by examiner

WIRE LUG CONNECTOR

BACKGROUND OF THE INVENTION

The subject matter herein relates generally to wire lug connectors.

Power connectors are used to connect power wires to substrates, such as circuit boards or bus bars. Typically, the power connectors are plugged into a complementary power header that is mounted to the circuit board or bus bar. Such systems are expensive because two connectors are needed. Additionally, multiple interfaces are provided between the substrate, power header, power connector and power wire. To overcome the problems associated with such systems, at least some systems use wire lugs that are soldered or bolted to the circuit board or bus bar. However, both of these solutions require special operations or tooling and add cost.

A need remains for a wire lug connector that may be terminated to a substrate in a cost effective and reliable manner.

BRIEF DESCRIPTION OF THE INVENTION

In one embodiment, a wire lug connector is provided that includes a lug having a termination end configured to be terminated to a conductor of a wire. The lug has a conductive base at a mounting end configured to be mounted to a substrate. The base has a plurality of compliant pins extending from a bottom of the base. The compliant pins are electrically connected to the conductor by the base. The compliant pins are configured to be mechanically and electrically connected to the substrate.

Optionally, the lug may be directly coupled to the substrate by the compliant pins to supply power from the conductor to the substrate. The compliant pins may be press-fit into corresponding vias in the substrate. The compliant pins may be formed integral with the base and terminating end of the lug.

Optionally, the compliant pins each have double ended press-fit sections at opposite heads and tails of the compliant pins. The head may be electrically and mechanically coupled to the base. The tail may be mechanically and electrically coupled to the substrate. The tail may include a press-fit section configured to be press-fit into corresponding vias in the substrate. The tail may be configured to be soldered to the substrate. The head may include a press-fit section configured to be press-fit into a corresponding opening in the base.

Optionally, the wire lug connector may include a dielectric housing having a chamber receiving the lug. The compliant pins may extend from the base exterior of the dielectric housing for termination to the substrate. The base may have an array of openings extending therethrough. The compliant pins may be press fit into the openings and may extending from a bottom of the base. The housing may extend over the openings along a top of the base to stop the compliant pins from being pressed through the base when the lug is coupled to the substrate.

In another embodiment, a wire lug connector is provided including a lug having a termination end configured to be terminated to a power conductor of a power wire. The lug has a conductive base at a mounting end configured to be mounted to a substrate. The base has a plurality of compliant pins extending from a bottom of the base. The compliant pins are electrically connected to the power conductor by the base. The compliant pins are configured to be mechanically and electrically connected to the substrate to supply power to the substrate. The wire lug connector includes a dielectric housing having a chamber. The dielectric housing holds the lug therein.

In a further embodiment, a wire lug connector is provided including a dielectric housing having a first chamber and a second chamber and power wires each having a power conductor. Lugs are received in the corresponding first and second chambers. The lugs each having a termination end terminated to the corresponding power conductor and a conductive base at a mounting end thereof. The bases are configured to be mounted to a substrate and each have a plurality of compliant pins extending from a bottom of the corresponding base. The compliant pins are electrically connected to the corresponding power conductor by the base. The dielectric housing positions the lugs relative to one another such that the compliant pins are configured to be mechanically and electrically connected to the substrate to supply power to the substrate.

DETAILED DESCRIPTION OF THE INVENTION

Figure 1:
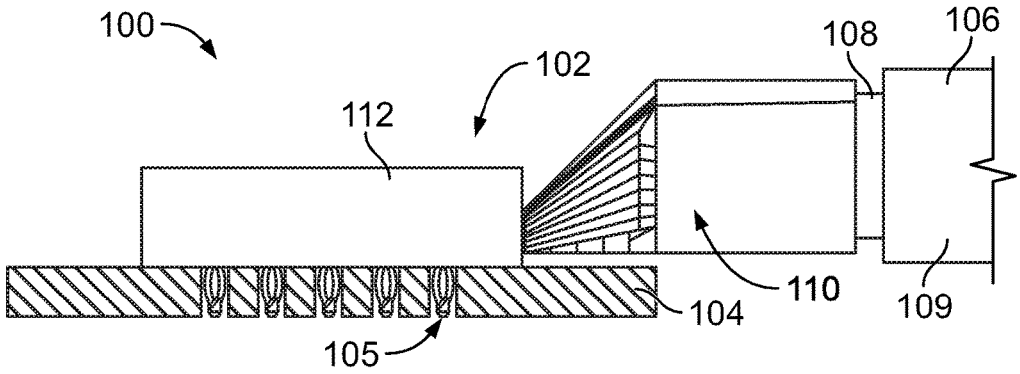
FIG. 1 illustrates an electrical connector system formed in accordance with an exemplary embodiment.

FIG. 1 illustrates an electrical connector system 100 formed in accordance with an exemplary embodiment. The electrical connector system 100 includes a wire lug connector 102 that is configured to be directly connected to a substrate 104. In an exemplary embodiment, the substrate 104 is a circuit board, and may be referred to herein after as circuit board 104. Other types of substrates may be used in alternative embodiments, such as a bus bar. The wire lug connector 102 is directly mechanically and electrically connected to the substrate 104 to supply power to the substrate 104. In an exemplary embodiment, the substrate 104 includes openings or vias 105 therein. The wire lug connector 102 is connected to the vias 105. For example, as a circuit board 104, the vias 105 may be plated vias and the wire lug connector 102 may have pins that are press-fit into the plated vias 105.

The wire lug connector 102 is shown terminated to a wire 106 having a conductor 108. In an exemplary embodiment, the wire 106 is a power wire and the conductor 108 is a power conductor that electrically conducts power from a source. The conductor 108 is surrounded by a jacket 109. Optionally, multiple conductors 108 may be provided. Optionally, the wire 106 may include signal conductors in addition to, or in lieu of, the power conductors.

The wire lug connector 102 includes a lug 110 configured for being terminated to the wire 106. The wire lug connector 102 includes a housing 112 that holds the lug 110. The housing 112 is manufactured from a dielectric material, such as a plastic material, and may shroud the lug 110 to protect against inadvertent touching of the lug 110. The lug 110 creates a direct electrical path between the conductor 108 and the substrate 104. The lug 110 is directly connected to the substrate 104 without the need for a separate header or other type of connector between the wire lug connector 102 and the substrate 104. Directly connecting the lug 110 to the substrate 104 eliminates interfaces between the substrate 104 and the conductor 108, which may reduce the overall cost and complexity of the electrical connector system 100.

Figure 2:
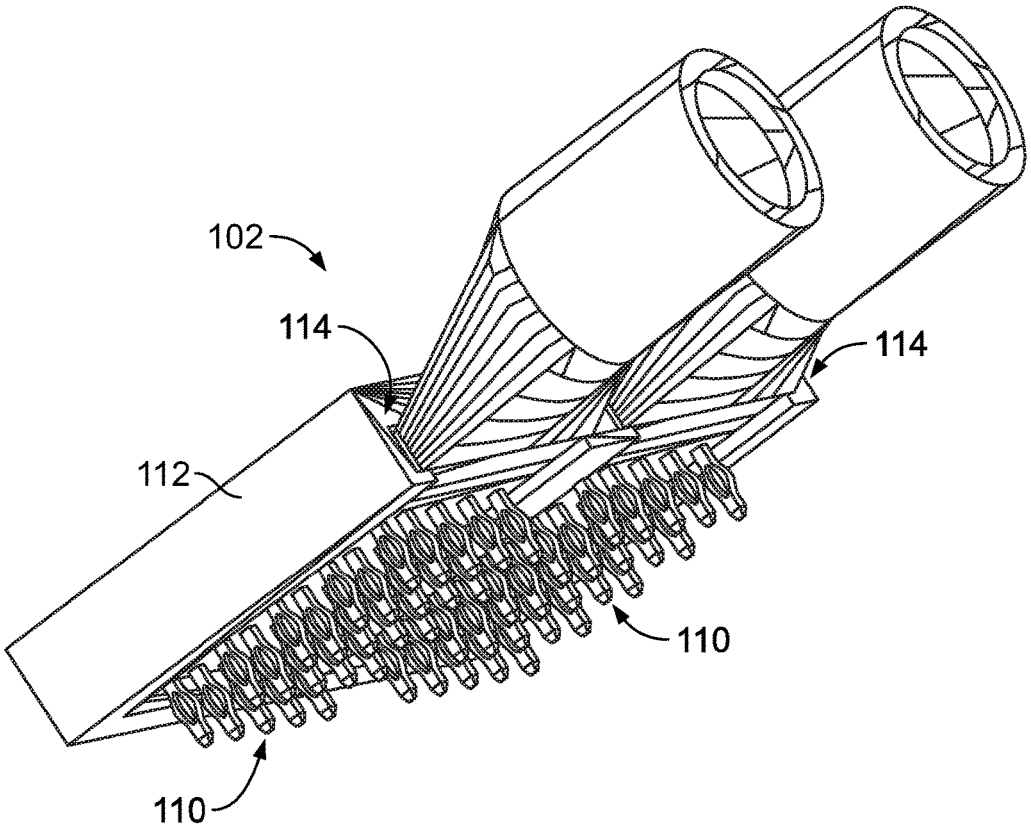
FIG. 2 is a perspective view of a wire lug connector of the electrical connector system.

FIG. 2 is a perspective view of the wire lug connector 102 showing a pair of lugs 110 held by the housing 112. The housing 112 includes one or more chambers 114 that receive corresponding lugs 110. The housing 112 may hold any number of lugs 110. The housing 112 may position the lugs 110 for mounting to the substrate 104. The housing 112 holds the relative positions of the lugs 110 with respect to one another for mounting to the substrate 104 (shown in FIG. 1). Optionally, the housing 112 may be separately secured to the substrate 104, such as using fasteners, a clip, or another securing means.

Figure 3:
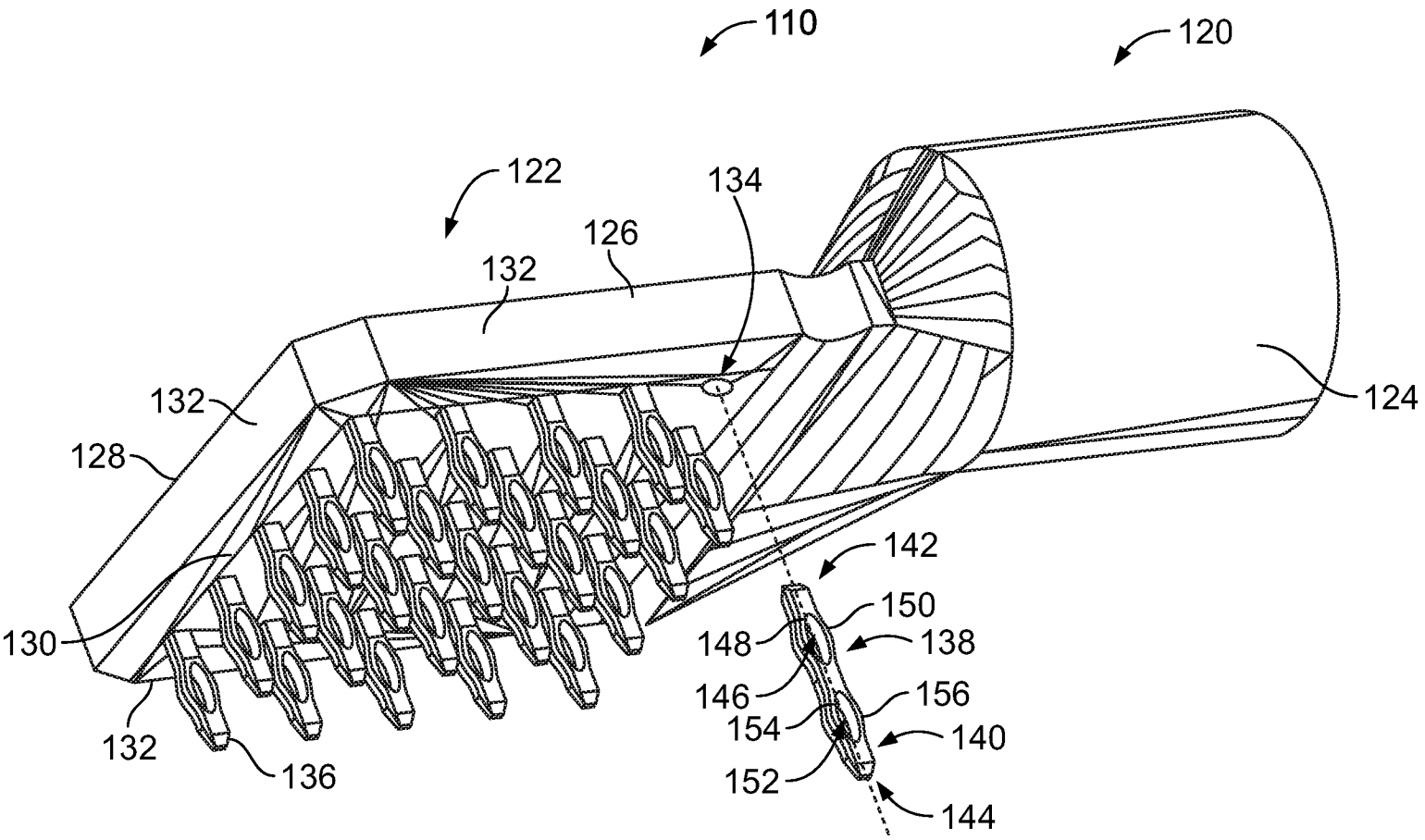
FIG. 3 illustrates a lug of the wire lug connector formed in accordance with an exemplary embodiment.

FIG. 3 illustrates the lug 110 formed in accordance with an exemplary embodiment. The lug 110 has a termination end 120 configured to be terminated to the conductor 108 of the wire 106 (both shown in FIG. 1) and a mounting end 122 configured to be terminated to the substrate 104 (shown in FIG. 1).

In an exemplary embodiment, the termination end 120 includes a crimp barrel 124 that receives the conductor 108. The crimp barrel 124 may be crimped to the conductor 108 to mechanically and electrically connect the lug 110 to the conductor 108. The crimp barrel 124 may be crimped to the jacket 109 (shown in FIG. 1) of the wire 106 surrounding the conductor 108 in addition to the conductor 108. In alternative embodiments, the termination end 120 may have features other than the crimp barrel 124 for mechanically and electrically connecting the lug 110 to the conductor 108. For example, the termination end 120 may be soldered to the conductor 108 and the termination end 120 may include features that may be soldered to the conductor 108. Other types of termination ends may be provided in alternative embodiments.

The lug 110 includes a conductive base 126 at the mounting end 122. The base 126 is integral with the crimp barrel 124. The base 126 may have any size or shape depending on the particular application. In the illustrated embodiment, the base 126 is rectangular shaped, however the base 126 may have other shapes in alternative embodiments. The base 126 is a generally flat plate having a top 128, a bottom 130 and a plurality of sides 132 extending between the top 128 and the bottom 130.

The base 126 includes an array of openings 134. Optionally, the openings 134 may extend entirely through the base 126 between the top 128 and the bottom 130. Alternatively, the openings 134 may extend only partially through the base 126, such as from the bottom 130 to an interior portion of the base 126. The openings 134 receive compliant pins 136 of the lug 110. The compliant pins 136 define the mating interface with the substrate 104. The compliant pins 136 extend from the bottom 130 of the base 126 for termination to the substrate 104. The compliant pins 136 are electrically connected to the conductor 108 by the base 126. The compliant pins 136 are configured to be mechanically and electrically connected to the circuit substrate 104 to supply power from the conductor 108 to the substrate 104.

One of the compliant pins 136 is shown outside of the base 126 and poised for loading into the corresponding opening 134. In an exemplary embodiment, the compliant pins 136 are double ended compliant pins having press-fit sections 138, 140 at heads 142 and tails 144, respectively.

The press-fit section 138 at the head 142 is configured to be loaded into the corresponding opening 134. The press-fit section 138 is compliant and is deformed when pressed into the openings 134. The press-fit section 138 is held in the opening 134 by an interference fit. In the illustrated embodiment, the press-fit section 138 is an eye-of-the-needle type of structure having an opening 146 surrounded by a pair of legs 148, 150. The legs 148, 150 may be flexed inward into the opening 146 when the press-fit section 138 is loaded into the opening 134. The legs 148, 150 press outward against the base 126 to mechanically and electrically connect the compliant pin 136 to the base 126. Other types of press-fit sections 138 may be provided in alternative embodiments.

The press-fit section 140 at the tail 144 is configured to be loaded into the corresponding via 105 (shown in FIG. 1). The press-fit section 140 is compliant and is deformed when pressed into the via 105. The press-fit section 140 is held in the via 105 by an interference fit. In the illustrated embodiment, the press-fit section 140 is an eye-of-the-needle type of structure having an opening 152 surrounded by a pair of legs 154, 156. The legs 154, 156 may be flexed inward into the opening 152 when the press-fit section 140 is loaded into the via 105. The legs 154, 156 press outward against the substrate 104 (shown in FIG. 1) to mechanically and electrically connect the compliant pin 136 to the substrate 104. Other types of press-fit sections 140 may be provided in alternative embodiments.

In an alternative embodiment, rather than being a double ended press-fit pin, the compliant pin 136 may be a single-ended press-fit pin. For example, the compliant pin 136 may include either the press-fit section 138 or the press-fit section 140; however, in such embodiments, the compliant pin 136 does not include both press-fit sections 138, 140. For example, a compliant pin having only the press-fit section 138 may be held in the base 126 by an interference or press fit; however the tail 144 may be terminated to the substrate 104 in a different manner. For example, the tail 144 may be a solder tail configured to be surface mounted to the substrate 104. The tail 144 may be soldered to a corresponding pad on the surface of the substrate 104. Alternatively, the tail 144 may define a spring beam configured to be resiliently deflected against a pad on the surface of the substrate 104 at a separable mating interface that is not soldered to the substrate 104. In other alternative embodiments, rather than being surface mounted, the compliant pins 136 may be terminated to the substrate 104 in a different manner, such as by loading the tail 144 through a via in the substrate 104 and soldering the tail 144 in the via of the substrate 104.

In other alternative embodiments, the single-ended press-fit pin may include the press-fit section 140 configured to be interference or press fit into the vias 105 (shown in FIG. 1) of the substrate 104; however the head 142 may be terminated to the base 126 in a different manner. For example, the head 142 may be soldered to the base 126, welded to the base 126, or otherwise secured to the base 126. The head 142 may be formed integral with the base 126. For example, the base 126 may be stamped and formed with the crimp barrel 124 at one end and the compliant pins 136 at the opposite end of a common stamped and formed body.

Figure 4:
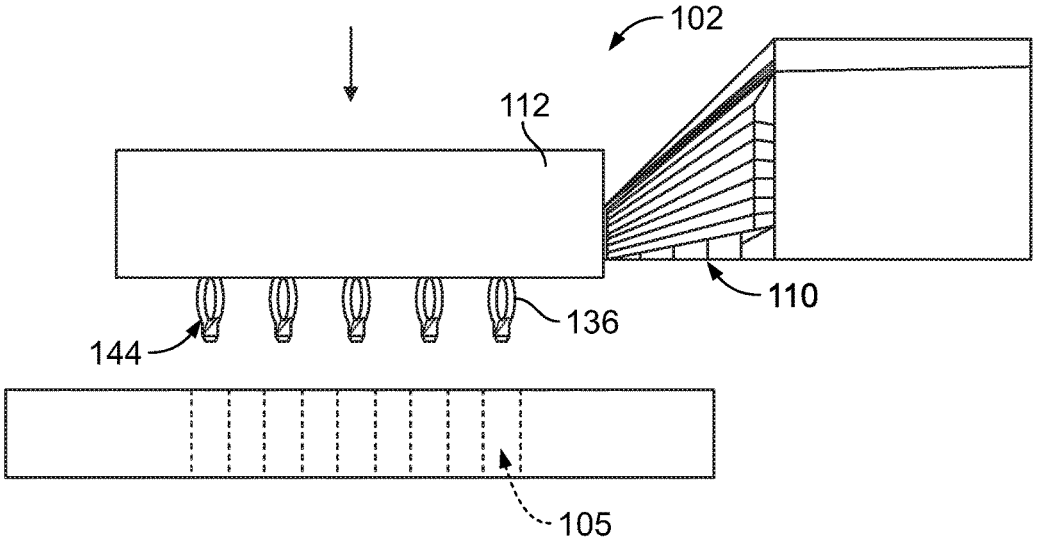
FIG. 4 is an assembled view of the wire lug connector poised and positioned for connection to a substrate.

FIG. 4 is an assembled view of the wire lug connector 102 poised and positioned for connection to the substrate 104. The lug 110 is held by the housing 112. The lug 110 is held over the substrate 104 and the compliant pins 136 are aligned with the vias 105. The compliant pins 136 extend from the base 126 (shown in FIG. 3) exterior of the dielectric housing 112 for termination to the substrate 104. During assembly, the lug 110 is pressed onto the substrate 104 with the tails 144 being press-fit in the corresponding vias 105.

Figure 5:
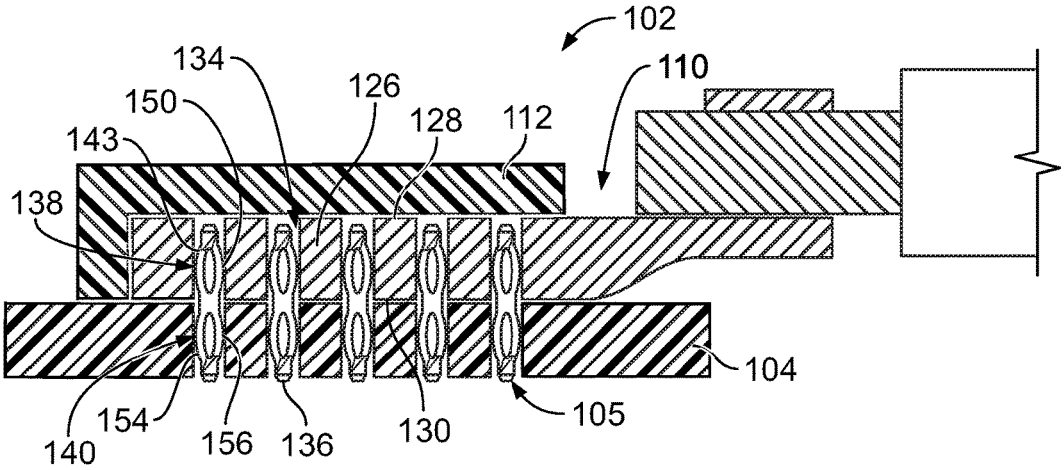
FIG. 5 is a cross-sectional view of the wire lug connector terminated to the substrate.

FIG. 5 is a cross-sectional view of the wire lug connector 102 terminated to the substrate 104. The compliant pins 136 are terminated to the substrate 104. The press-fit sections 140 engage the walls defining the vias 105 to mechanically and electrically connect the lug 110 to the substrate 104. The press-fit sections 140 engage the substrate 104 in an interference fit. The legs 154, 156 are partially compressed when loaded into the vias 105. The legs 154, 156 press outward against the substrate 104 to ensure that the compliant pins 136 are electrically connected to the substrate 104.

The compliant pins 136 are terminated to the base 126. The compliant pins 136 are press fit into the openings 134 and extend from the bottom 130 of the base 126. The housing 112 extends over the openings 134 along the top 128 of the base 126 and prevents the compliant pins 136 from exiting through the top 128 of the base 126, such as during loading of the compliant pins 136 into the base 126 or when the lug 110 is coupled to the substrate 104. The press-fit sections 138 engage the walls defining the openings 134 to mechanically and electrically connect the compliant pins 136 to the base 126. The press-fit sections 138 engage the base 126 in an interference fit. The legs 148, 150 are partially compressed when loaded into the openings 134. The legs 148, 150 press outward against the base 126 to ensure that the compliant pins 136 are electrically connected to the base 126.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A wire lug connector comprising:

a lug having a crimp barrel at a termination end of the lug configured to be terminated to a conductor of a wire, the lug having a conductive base integral with and extending from the crimp barrel at a mounting end of the lug, the base having a plate having a generally flat top and a generally flat bottom configured to face a substrate, the base having generally parallel sides extending between the top and the bottom and a front end extending between the top and the bottom and between the sides generally opposite the termination end, the base having a plurality of openings arranged in an array in a mounting area along the bottom of the base, the openings receive corresponding compliant pins extending from the bottom of the base, the compliant pins each having double ended press-fit sections at opposite heads and tails of the compliant pins, the compliant pins being mechanically and electrically connected to the base by the press-fit sections at the heads, the compliant pins being electrically connected to the conductor by the base, the compliant pins being configured to be mechanically and electrically connected to the substrate by press-fitting the press-fit sections of the tails of the compliant pins into the substrate, the arrangement of the openings and the compliant pins spanning a majority of the bottom of the base between the sides, the arrangement of the openings and the compliant pins spanning a majority of the bottom of the base between the front end and the termination end; and a dielectric housing having a chamber receiving the lug, wherein the dielectric housing extends over the openings along the top of the base to prevent the compliant pins from exiting through the top of the base when the lug is coupled to the substrate.

2. The wire lug connector of claim 1, wherein the lug is configured to be directly coupled to the substrate by the compliant pins to supply power from the conductor to the substrate.

3. The wire lug connector of claim 1, wherein the compliant pins extend from the base exterior of the dielectric housing for termination to the substrate.

4. The wire lug connector of claim 1, wherein the wire barrel receives the wire along a wire axis parallel to the bottom of the base.

5. The wire lug connector of claim 1, wherein the compliant pins are arranged in rows and columns, the compliant pins having a generally uniform spacing along the rows, the compliant pins having a generally uniform spacing along the columns, the spacing between the compliant pins in the rows being the same as the spacing between the compliant pins in the columns.

6. The wire lug connector of claim 1, wherein the compliant pins are the only structures extending between the bottom of the plate of the base and the substrate.

7. The wire lug connector of claim 1, wherein the press-fit sections at the heads of each of the compliant pins are eye-of-the-needle pins and wherein the press-fit sections at the tails of each of the compliant pins are eye-of-the-needle pins.

8. The wire lug connector of claim 1, wherein the press-fit section at the head of each of the compliant pins is provided at a distal end of the head and wherein the press-fit section at the tail of each of the compliant pins is provided at a distal end of the tail.

9. A wire lug connector comprising:

a lug having a crimp barrel at a termination end of the lug configured to be terminated to a power conductor of a power wire, the lug having a conductive base integral with and extending from the crimp barrel at a mounting end of the lug, the base having a plate having a generally flat top and a generally flat bottom configured to face a substrate, the base having generally parallel sides extending between the top and the bottom and a front end extending between the top and the bottom and between the sides generally opposite the termination end, the base having a plurality of openings arranged in an array in a mounting area along the bottom of the base, the openings receive individual compliant pins extending from the bottom of the base, the compliant pins each having double ended press-fit sections at opposite heads and tails of the compliant pins, the compliant pins being mechanically and electrically connected to the base by the press-fit sections at the heads, the compliant pins being electrically connected to the power conductor by the base, the compliant pins being configured to be mechanically and electrically connected to the substrate by the press-fit sections at the tails to supply power to the substrate; and a dielectric housing having a chamber open at a bottom and a rear of the dielectric housing, the dielectric housing covering the plate and holding the lug therein with the termination end and crimp barrel extending from the dielectric housing through the rear and with the compliant pins extending from the housing through the bottom, the housing extending over the openings along the top of the base to prevent the compliant pins from exiting through the top of the base when the lug is coupled to the substrate.

10. The wire lug connector of claim 9, wherein the compliant pins are configured to be press-fit into corresponding vias in the substrate.

11. The wire lug connector of claim 9, wherein the press-fit sections at the heads of each of the compliant pins are eye-of-the-needle pins and wherein the press-fit sections at the tails of each of the compliant pins are eye-of-the-needle pins.

12. The wire lug connector of claim 9, wherein the press-fit section at the head of each of the compliant pins is provided at a distal end of the head and wherein the press-fit section at the tail of each of the compliant pins is provided at a distal end of the tail.

13. A wire lug connector comprising:

a dielectric housing having a first chamber and a second chamber;

power wires each having a power conductor; and lugs received in the corresponding first and second chambers, the lugs each having a crimp barrel at a termination end of the lug terminated to the corresponding power conductor, the lugs each having a conductive base integral with and extending from the crimp barrel at a mounting end thereof, the bases being configured to be mounted to a substrate, the bases each having a plate having a generally flat top and a generally flat bottom configured to face a substrate, the base having sides extending between the top and the bottom and a front end extending between the top and the bottom and between the sides generally opposite the termination end, the bases each having a plurality of openings arranged in an array in a mounting area along the bottom of the base, the openings receive corresponding compliant pins extending from the bottom of the base, the compliant pins being arranged in rows and columns, a spacing in the rows being the same as a spacing in the columns, the compliant pins each having double ended press-fit sections at opposite heads and tails of the compliant pins, the compliant pins being mechanically and electrically connected to the base by the press-fit sections at the heads, the compliant pins being configured to be mechanically and electrically connected to the substrate by press-fitting the press-fit sections of the tails of the compliant pins into the substrate, the compliant pins being electrically connected to the corresponding power conductor by the base;

wherein the dielectric housing positions the lugs relative to one another such that the compliant pins are configured to be mechanically and electrically connected to the substrate to supply power to the substrate; and wherein the housing extends over the openings along the tops of the bases of the lugs to prevent the compliant pins from exiting through the tops of the bases when the lugs are coupled to the substrate.

14. The wire lug connector of claim 13, wherein the compliant pins are configured to be press-fit into corresponding vias in the substrate.

15. The wire lug connector of claim 13, wherein the press-fit sections at the heads of each of the compliant pins are eye-of-the-needle pins and wherein the press-fit sections at the tails of each of the compliant pins are eye-of-the-needle pins.

16. The wire lug connector of claim 13, wherein the press-fit section at the head of each of the compliant pins is provided at a distal end of the head and wherein the press-fit section at the tail of each of the compliant pins is provided at a distal end of the tail.

* * * * *